US008075293B2

(12) United States Patent
Ouwenga

(10) Patent No.: US 8,075,293 B2
(45) Date of Patent: Dec. 13, 2011

(54) ROTARY BLOWER WITH CORROSION-RESISTANT ABRADABLE COATING

(75) Inventor: Daniel R. Ouwenga, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 376 days.

(21) Appl. No.: 11/752,345

(22) Filed: May 23, 2007

(65) Prior Publication Data

US 2008/0292486 A1 Nov. 27, 2008

(51) Int. Cl.

| | |
|---|---|
| ***F01C 21/00*** | (2006.01) |
| ***F01C 1/18*** | (2006.01) |
| ***F01C 1/24*** | (2006.01) |
| ***F04C 15/00*** | (2006.01) |
| ***F04C 2/08*** | (2006.01) |

(52) U.S. Cl. ..... 418/206.9; 418/178; 418/179; 418/206.1

(58) Field of Classification Search ..... 418/178, 418/179, 206.1, 206.9
See application file for complete search history.

(56) References Cited

U.S. PATENT DOCUMENTS

| | | | | |
|---|---|---|---|---|
| 4,274,811 | A * | 6/1981 | Rao | 417/64 |
| 4,466,785 | A * | 8/1984 | Biswas | 418/152 |
| 4,484,997 | A * | 11/1984 | Secrist et al. | 205/384 |
| 4,595,349 | A * | 6/1986 | Preston et al. | 418/206.1 |
| 4,638,570 | A * | 1/1987 | Soeters, Jr. | 33/562 |
| 5,055,016 | A * | 10/1991 | Kawade | 418/179 |
| 5,080,934 | A * | 1/1992 | Naik et al. | 427/271 |
| 5,314,321 | A * | 5/1994 | Yamamoto et al. | 418/178 |
| 6,506,037 | B1 * | 1/2003 | Bush et al. | 418/178 |
| 6,688,867 | B2 * | 2/2004 | Suman et al. | 418/178 |
| 6,817,844 | B1 * | 11/2004 | Wang | 417/410.4 |
| 6,986,652 | B2 * | 1/2006 | Bush et al. | 418/178 |
| 6,988,877 | B2 * | 1/2006 | Bush et al. | 418/178 |
| 7,115,197 | B2 * | 10/2006 | Reed et al. | 205/118 |
| 7,153,111 | B2 * | 12/2006 | Bush et al. | 418/178 |
| 2004/0213919 | A1 * | 10/2004 | Fried | 427/455 |
| 2007/0147990 | A1 * | 6/2007 | Kamimura et al. | 415/173.1 |

FOREIGN PATENT DOCUMENTS

| | | | |
|---|---|---|---|
| EP | 0 765 951 | A | 4/1997 |
| EP | 1 484 426 | A | 12/2004 |
| JP | 07 109982 | | 4/1995 |
| WO | WO 03/061852 | A | 7/2003 |
| WO | WO 2008120046 | A1 * | 10/2008 |

OTHER PUBLICATIONS

Shimada and Hasegawa, Preparation of Titanium Nitride Films from Amide Precursors Synthesized by Electrolysis, Jan. 2003, Journal of American Ceramic Society, vol. 86, pp. 177-179.*

PCT Search Report, PCT IB/2008/001261 search completed Nov. 11, 2008.

* cited by examiner

*Primary Examiner* — Mary A Davis
(74) *Attorney, Agent, or Firm* — Dykema Gossett PLLC

(57) ABSTRACT

A rotary blower rotor includes a rotor body having a corrosion-resistant coating covering the rotor body. An abradable coating covers at least a portion of the corrosion-resistant coating for providing an essentially zero operating clearance for increasing a volumetric efficiency of the rotary blower. A rotary blower including a rotor with a corrosion-resistant coating is also provided.

18 Claims, 3 Drawing Sheets

ROTARY BLOWER WITH CORROSION-RESISTANT ABRADABLE COATING

FIELD OF THE INVENTION

The present invention relates in general to a rotary blower, such as a Roots-type rotary blower, typically used as an automotive supercharger, with an abradable coating for increasing the volumetric efficiency of the rotary blower, and, in particular, to a corrosion-resistant rotary blower rotor having an abradable coating.

BACKGROUND OF THE DISCLOSURE

Rotary blowers of the Roots type typically include a pair of meshed, lobed rotors having either straight lobes or lobes with a helical twist with each of the rotors being mounted on a shaft, and each shaft having mounted thereon a timing gear. Rotary blowers, particularly Roots blowers are employed as superchargers for internal combustion engines and normally operate at relatively high speeds, typically in the range of 10,000 to 20,000 revolutions per minute (rpm) for transferring large volumes of a compressible fluid like air, but without compressing the air internally within the blower.

It is desirable that the rotors mesh with each other, to transfer large volumes of air from an inlet port to a higher pressure at the outlet port. Operating clearances to compensate for thermal expansion and/or bending due to loads are intentionally designed for the movement of the parts so that the rotors actually do not touch each other or the housing. Also, it has been the practice to epoxy coat the rotors such that any inadvertent contact does not result in the galling of the rotors or the housing in which they are contained. The designed operating clearances, even though necessary, limit the efficiency of the rotary blower by allowing leakage. This creation of a leakage path reduces the volumetric efficiency of the rotary blower.

One known approach to improving pumping efficiency of a rotary blower is the use of a coating with an abradable material. While known supercharger rotor abradable coatings provide, among other things, increased volumetric efficiency of the rotary blower and sufficient lubricating properties, they have been found to exhibit relatively poor corrosion resistance, limiting their use to supercharger applications in which the supercharger is not be exposed to a corrosive environment. For example, known supercharger abradable coatings are generally incompatible with marine engines that operate in a salt water environment, as the relatively high salt content ambient air may corrode the rotors.

BRIEF SUMMARY OF THE INVENTION

A rotary blower rotor is disclosed that includes a rotor body having a corrosion-resistant coating covering the rotor body. An abradable coating covers at least a portion of the corrosion-resistant coating for providing an essentially zero operating clearance for increasing a volumetric efficiency of the rotary blower. The corrosion-resistant coating inhibits corrosion of the rotor body during exposure to a corrosive environment.

In an embodiment of the present invention, the corrosion-resistant coating comprises an electrolytic ceramic coating that exhibits excellent resistance to various corrosive environments, and forms a foundation exhibiting excellent adhesion to the abradable coating.

DETAILED DESCRIPTION

Figure 1:
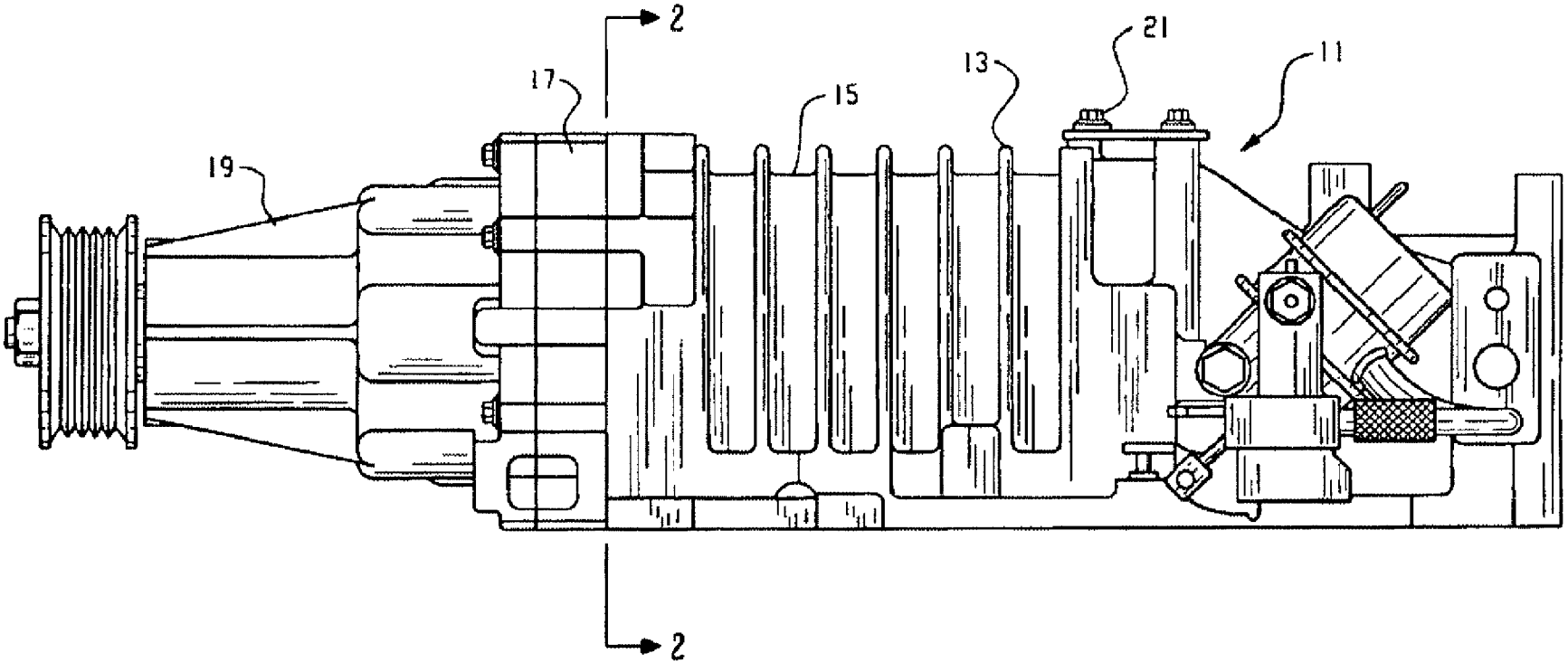
FIG. 1 is a side elevation view of an exemplary Roots-type rotary blower of the type with which the present invention may be utilized.
Figure 2:
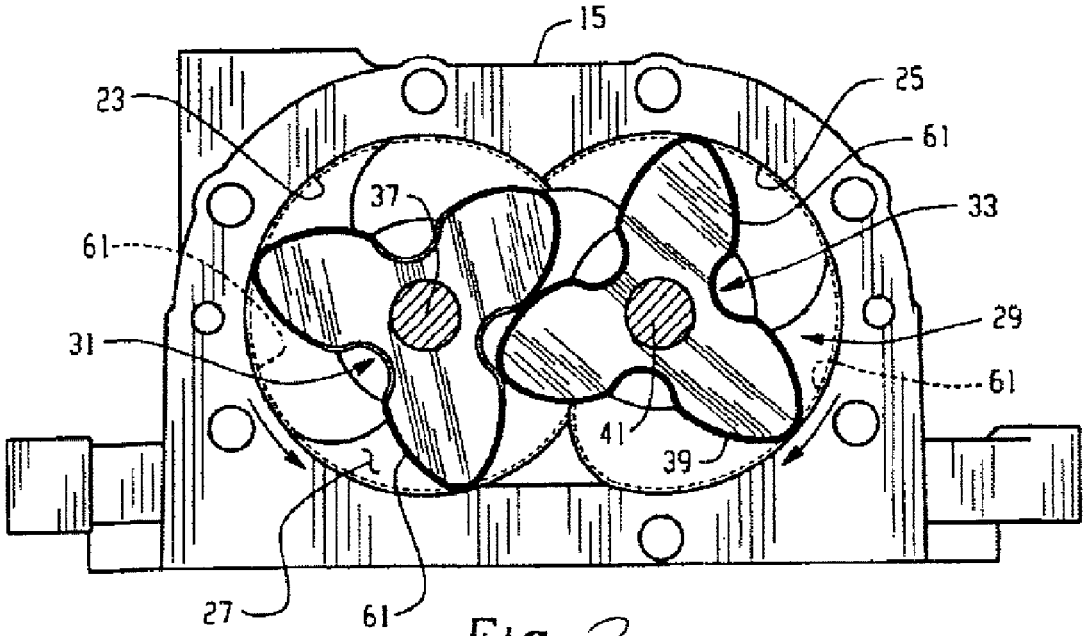
FIG. 2 is a cross-sectional view of the exemplary Roots-type rotary blower of FIG. 1, showing a pair of rotors according to an embodiment of the present invention.

Referring now to the drawings, which are not intended to limit the present invention, and first in particular to FIGS. 1 and 2, there is shown an exemplary rotary pump or blower of the Roots type, generally designated 11. Rotary blower 11 may be better understood by reference to U.S. Pat. Nos. 4,828,467; 5,118,268; and 5,320,508, all of which are assigned to the Assignee of the present invention and hereby incorporated by reference.

As is well known in the art, rotary blowers are used typically to pump or transfer volumes of a compressible fluid such as air from an inlet port opening to an outlet port opening without compressing the air in the transfer volumes prior to exposing it to higher pressure air at the outlet opening. Rotary blower 11 comprises a housing assembly 13 which includes a main housing member 15, bearing plate 17, and the drive housing member 19. The three members are secured together by a plurality of fasteners 21.

Referring next to FIG. 2, the main housing member 15 is a unitary member defining cylindrical wall surfaces 23, 25 which define parallel transverse overlapping cylindrical chambers 27 and 29, respectively. Chambers 27, 29 have rotor-shaft subassemblies 31, 33, respectively mounted therein for counter-rotation, with axes substantially coincident with the respective axes of the blower 11 as is known in this art. Subassembly 31 has a helical twist in a counterclockwise direction as indicated by the arrow adjacent reference numeral 31 in FIG. 2. The subassembly 33 has a helical twist in the clockwise direction as shown by the arrow adjacent reference numeral 39 in FIG. 2. For purposes of explaining the use of the corrosion-resistant coating and abradable coating in accordance with the present invention, the subassemblies 31 and 33 will be considered identical, and only one will be described in reference to the use of the coatings hereinafter.

Figure 3:
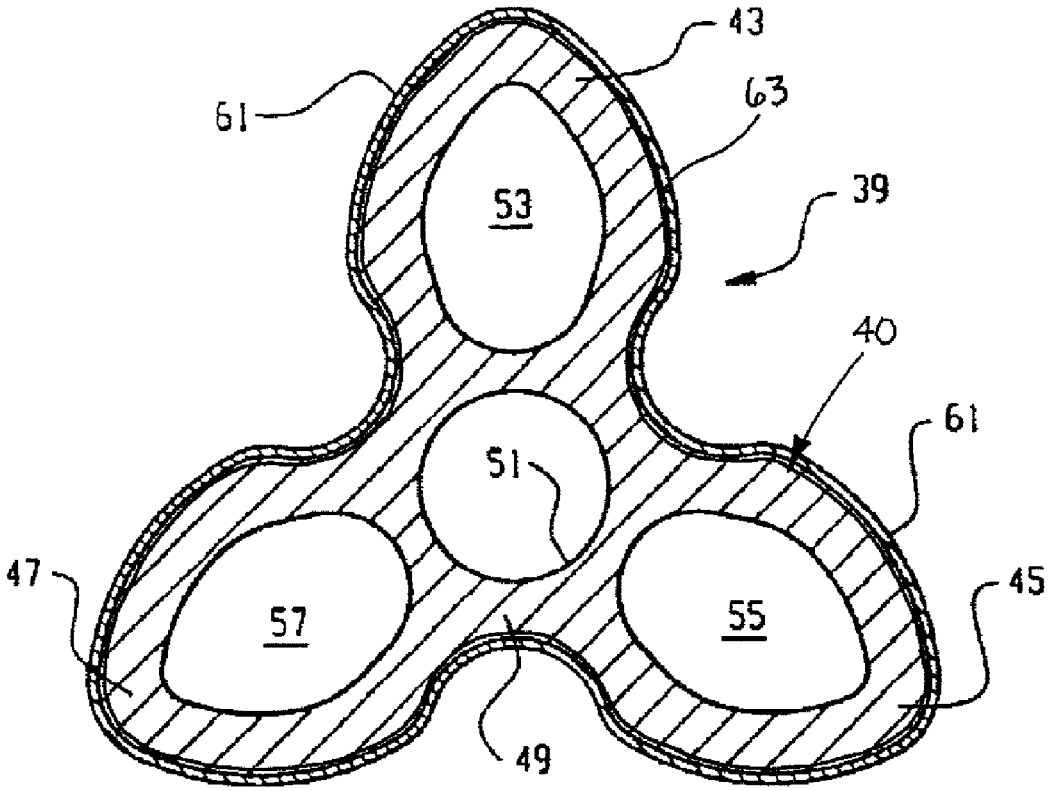
FIG. 3 is a cross-sectional view of a rotor shown in FIG. 2.

Referring also to FIG. 3, there is shown a cross-sectional view of a rotor 39. Rotor 39 comprises a body 40 having three separate lobes 43, 45, and 47 which connect together, or preferably are formed integrally, to define a generally cylindrical web portion 49. A shaft 37, 41 is disposed within a central bore portion 51. Each of the lobes 43, 45, and 47 may define hollow chambers 53, 55, 57, respectively therein, although the present invention is equally applicable to both solid and hollow rotors.

To facilitate a better understanding of the structure in accordance with the present invention and for ease of illustration FIG. 3 depicts rotor 39 as a straight lobed rotor. It should be understood that the present invention is equally applicable to any shaped rotor whether it is helical or straight lobed.

In FIG. 3, there is shown an abradable coating 61 preferably covering the entire outer surface of rotor 39. Coating 61 may include a mixture of a coating material base or matrix which is preferably an epoxy polymer resin matrix in powder form and a solid lubricant. Exemplary coatings 61 are described in U.S. Pat. No. 6,688,867, which is owned by the Assignee of the present invention and incorporated by reference herein in its entirety.

Referring still to FIG. 3, a corrosion-resistant coating 63 is disposed between the rotor 31 and the abradable coating 61. In an embodiment of the present invention, corrosion-resistant coating 63 is an electrolytic ceramic material, such as the electrolytic titanium ceramic coating Alodine® marketed by Henkel KGaA. The corrosion-resistant coating 63 may be deposited over the rotor 31 at a controlled thickness of approximately 5-7 microns (μm) with a tolerance of less than +/−0.5 microns (μm). The corrosion-resistant coating 63 may be applied with an electrostatic or air atomized spray process, but may also be applied with a liquid process such as a liquid spraying or immersion process. The adhesion of the corrosion-resistant coating 63 on the rotor surface may be improved with surface preparation of the substrate by mechanical means such as machining, sanding, grit blasting or the like, or alternatively with chemical means for surface treatment such as etching, degreasing, solvent cleaning or chemical treatment such as an alkaline or phosphate wash.

It is desirable for the corrosion-resistant coating 63 to maintain its structure without peeling at contact areas, and to have good adhesion to aluminum or other lightweight metals employed in the rotor 39. Also, the corrosion-resistant coating 63 should not be harmful to the catalytic converter or the heat exhaust gas oxygen (HEGO) sensor if any particles become entrained into the engine after the break-in period. As such, the corrosion-resistant coating 63 particles do need to be combustible. In addition, the corrosion-resistant coating 63 also has compatibility with gasoline, oil, water (including salt water), alcohol, exhaust gas, and synthetic lubricating oils.

In the development of the blower which uses the corrosion-resistant coating material of the present invention, a variety of coating materials were investigated. Table 1 lists the results of several of these coating materials.

TABLE 1

Corrosion-Resistant Coating Materials

| | Abradable Coating Only | Titanium Ceramic Coating | Teflon |
|---|---|---|---|
| Nominal Thickness | 80–130 μm | 5–7 μm | 40–60 μm |
| Operating Temperature | −40° to 150° C. | −40° to 600+° C. | −40° to 150° C. |
| Cure Time/Temp. | Approx. 20 min/200° C. | Approx. 1.5 min/ Room Temp. | Approx. 20 min/373° C. |
| Adhesion to Rotor | Very Good | Very Good | Okay |
| Adhesion to Abradable Coating | N/A | Excellent | Poor |
| ASTM-B117 Salt-Spray Test | Failed* | Passed** | Passed |

Figure 4:
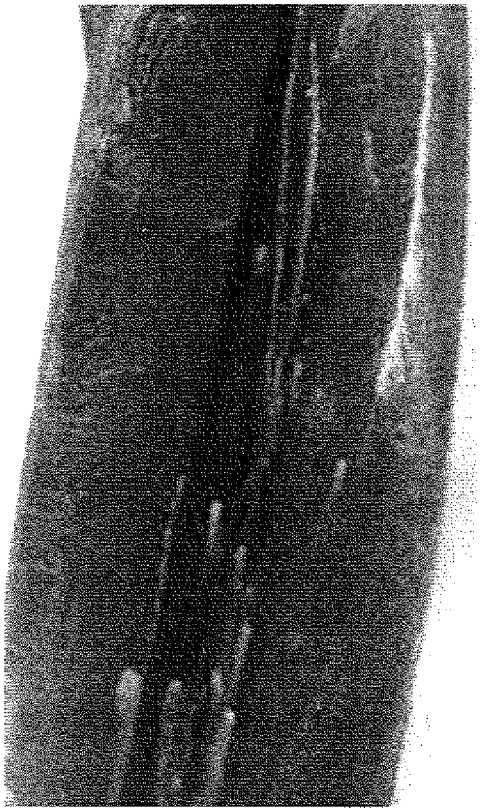
FIG. 4 is a photograph of a rotor according to an embodiment of the present invention shown after an ASTM-B117 salt spray test.
Figure 5:
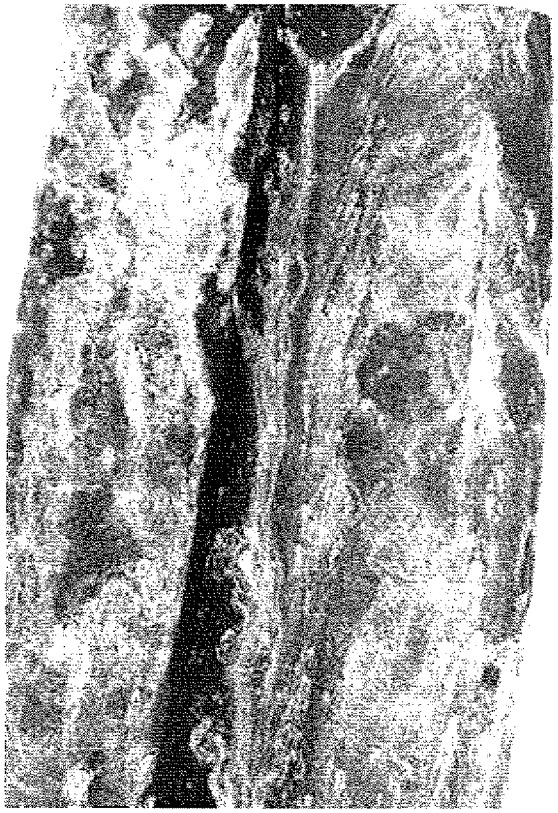
FIG. 5 Prior Art
FIG. 5 is a photograph of a prior art rotor having only an abradable coating shown after an ASTM-B117 salt spray test.

*Photograph of ASTM-B117 test results shown in FIG. 5.
**Photograph of ASTM-B117 test results shown in FIG. 4.

The abradable coating 61 is deposited over the corrosion-resistant coating 63 so that the abradable coating 61 and the corrosion-resistant coating 63 have a collective thickness ranging from about 80 microns (μm) to about 130 (μm). The coated rotors can have clearances due to manufacturing tolerances that may range from rotor to rotor from about 0 mils to about 7 mils, and rotor to housing that may range from about 0 mils to about 3 mils. Preferably, the thickness of the abradable coating material on the rotors is such that there is a slight interference fit between the rotors and the housing. During the assembly process, the rotary blower is operated on line for a brief break-in period. The term "break-in" as used herein is intended to refer to an operation cycle which lasts as a minimum approximately two minutes where the rotary blower undergoes a ramp from about 2000 rpm to about 16,000 rpm, and then back down. Of course, the break-in period can include but is not limited to any operation cycle employed to abrade the coating to an essentially zero operating clearance.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary blower rotor, comprising:

a rotor body;

a corrosion-resistant coating covering the rotor body, wherein the corrosion-resistant coating comprises an electrolytic ceramic coating; and an abradable coating covering at least a portion of the corrosion-resistant coating to form an outer surface of the rotor body for providing an essentially zero operating clearance for increasing a volumetric efficiency of the rotary blower, wherein the abradable coating is a mixture of an epoxy polymer resin matrix and a solid lubricant.

2. The rotary blower rotor of claim 1, wherein the corrosion-resistant coating has a thickness ranging from 5 microns to 7 microns.

3. The rotary blower rotor of claim 1, wherein the electrolytic ceramic coating includes a titanium ceramic.

4. The rotary blower rotor of claim 1, wherein the abradable coating and the corrosion-resistant coating have a collective thickness ranging from 80 microns to 130 microns.

5. The rotary blower of claim 1, wherein the rotor body has a surface treatment to improve adhesion to the corrosion-resistant coating.

6. The rotary blower of claim 1, wherein the electrolytic ceramic in the corrosion-resistant coating is combustible.

7. A rotary blower rotor, comprising:

a rotor body;

a corrosion-resistant coating comprising an electrolytic ceramic coating adhered to and covering the rotor body; and an abradable coating adhered to and covering at least a portion of the corrosion-resistant coating to form an outer surface of the rotor body for providing an essentially zero operating clearance for increasing a volumetric efficiency of the rotary blower, wherein the abradable coating is a mixture of an epoxy polymer resin matrix and a solid lubricant.

8. The rotary blower rotor of claim 7, wherein the electrolytic ceramic coating has a thickness ranging from 5 microns to 7 microns.

9. The rotary blower rotor of claim 7, wherein the electrolytic ceramic coating includes a titanium ceramic.

10. The rotary blower rotor of claim 7, wherein the abradable coating and electrolytic ceramic coating have a collective thickness ranging from 80 microns to 130 microns.

11. The rotary blower of claim 7, wherein the rotor body has a surface treatment to improve adhesion to the corrosion-resistant coating.

12. The rotary blower of claim 7, wherein the electrolytic ceramic in the corrosion-resistant coating is combustible.

13. A rotary blower, comprising:

a pair of rotors, each rotor including a corrosion-resistant coating covering the rotors and an abradable coating covering at least a portion of the corrosion-resistant coating to form an outer surface of the rotor body for providing an essentially zero operating clearance for increasing a volumetric efficiency of the rotary blower, wherein the corrosion-resistant coating comprises an electrolytic ceramic coating, and the abradable coating comprises a mixture of an epoxy polymer resin matrix and a solid lubricant.

14. The rotary blower of claim 13, wherein the corrosion-resistant coating has a thickness ranging from 5 microns to 7 microns.

15. The rotary blower of claim 13, wherein the electrolytic ceramic coating includes a titanium ceramic.

16. The rotary blower of claim 13, wherein the abradable coating and corrosion-resistant coating have a collective thickness ranging from 80 microns to 130 microns.

17. The rotary blower of claim 13, wherein the rotor body has a surface treatment to improve adhesion to the corrosion-resistant coating.

18. The rotary blower of claim 13, wherein the electrolytic ceramic in the corrosion-resistant coating is combustible.

* * * * *